US011524710B2

(12) United States Patent
Towns, Jr.

(10) Patent No.: US 11,524,710 B2
(45) Date of Patent: Dec. 13, 2022

(54) LOADING TURNTABLE SYSTEMS AND METHODS

(71) Applicant: Universal City Studios LLC, Universal City, CA (US)

(72) Inventor: Robbie Lewis Towns, Jr., Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 413 days.

(21) Appl. No.: 16/739,895

(22) Filed: Jan. 10, 2020

(65) Prior Publication Data

US 2020/0307658 A1 Oct. 1, 2020

Related U.S. Application Data

(60) Provisional application No. 62/826,306, filed on Mar. 29, 2019.

(51) Int. Cl.

| | |
|---|---|
| ***B61K 1/00*** | (2006.01) |
| *A63G 1/08* | (2006.01) |
| *B66B 21/12* | (2006.01) |
| *A63G 4/00* | (2006.01) |
| *A63G 31/10* | (2006.01) |

(52) U.S. Cl.

CPC ..... *B61K 1/00* (2013.01); *A63G 1/08* (2013.01); *A63G 4/00* (2013.01); *A63G 31/10* (2013.01); *B66B 21/12* (2013.01)

(58) Field of Classification Search

CPC ..... B65G 47/00; B65G 15/00; B66B 21/10; B61K 1/00; A61G 1/08

USPC ..... 198/324–325; 104/53

See application file for complete search history.

(56) References Cited

U.S. PATENT DOCUMENTS

| | | | | |
|---|---|---|---|---|
| 3,865,041 | A | 2/1975 | Bacon | |
| 4,543,886 | A | 10/1985 | Spieldiener et al. | |
| 6,142,286 | A * | 11/2000 | Ulrich | B66B 29/06 198/325 |
| 2010/0078291 | A1 | 4/2010 | Fritsche | |
| 2013/0059670 | A1 | 3/2013 | Crawford et al. | |

OTHER PUBLICATIONS

PCT/US2020/021083 Invitation to Pay Additional Fees dated May 27, 2020.

* cited by examiner

*Primary Examiner* — Kien T Nguyen

(74) *Attorney, Agent, or Firm* — Fletcher Yoder, P.C.

(57) ABSTRACT

An attraction loading system is provided that includes a loading platform. The loading platform includes a rotational portion configured to rotate about a central vertical axis of the loading platform and a stationary portion extending between a first edge and a second edge of the loading platform. The first edge and the second edge of the stationary portion include respective interfaces of the stationary portion with the rotational portion. The rotational portion rotates from the first edge to the second edge. The attraction loading system further includes a loading path disposed about a circumference of the loading platform.

20 Claims, 4 Drawing Sheets

LOADING TURNTABLE SYSTEMS AND METHODS

CROSS-REFERENCE TO RELATED APPLICATIONS

This application claims the benefit of U.S. Provisional Application Ser. No. 62/826,306, entitled "LOADING TURNTABLE SYSTEMS AND METHODS," filed Mar. 29, 2019, which is hereby incorporated by reference in its entirety for all purposes.

BACKGROUND

The present disclosure relates generally to the field of amusement parks. More particularly, embodiments of the present disclosure relate to systems and methods for implementing flexible passenger loading time in an attraction of an amusement park.

Recently, there has been a growing interest in increasing an efficiency of loading passengers into ride vehicles of attractions of amusement parks. For example, some attractions may include loading systems that have ride vehicles continuously moving along a loading zone as passengers unload from a ride vehicle and as new passengers load into the ride vehicle. However, some passengers may take a long time to leave the ride vehicle and/or may take a long time to board the ride vehicle. That is, a loading passenger may not be fully boarded and secured within the ride vehicle before the ride vehicle reaches an end of the loading zone. In such instances, movement of all of the ride vehicles through the attraction and/or the loading zone may be affected to give the loading passenger extra time to board the ride vehicle. For example, in one scenario, each ride vehicle may come to a complete stop in order to allow the loading passenger extra time in the loading zone to board the ride vehicle. Slowing or stopping of the ride vehicles' movement through the attraction may be detrimental to a throughput of the attraction, which can lead to increased waiting times and decreased revenue for the amusement park.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, an attraction loading system includes a loading platform. The loading platform includes a rotational portion configured to rotate about a central vertical axis of the loading platform and a stationary portion extending between a first edge and a second edge of the loading platform. The first edge and the second edge of the stationary portion include respective interfaces of the stationary portion with the rotational portion. The rotational portion rotates from the first edge to the second edge. The attraction loading system further includes a loading path disposed about a circumference of the loading platform and a ride vehicle configured to travel along the loading path.

In an embodiment, a method to load passengers into ride vehicles includes flagging a ride vehicle that is traveling along a first portion of a loading path and directing the flagged ride vehicle to stop along a second portion of the loading path. The method also includes determining an occupancy status of the flagged ride vehicle while stopped along the second portion of the loading path. The method further includes directing the flagged ride vehicle from the second portion of the loading path to travel along the first portion of the loading path based on the occupancy status.

In an embodiment, an attraction loading platform system includes a loading platform. The loading platform includes a stationary portion and a rotational portion. The rotational portion rotates about a central vertical axis of the loading platform and from a first edge of the stationary portion to a second edge of the stationary portion. The attraction loading platform system further includes a motor configured enable rotation of the rotational portion and a controller configured to control a speed of the rotation.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
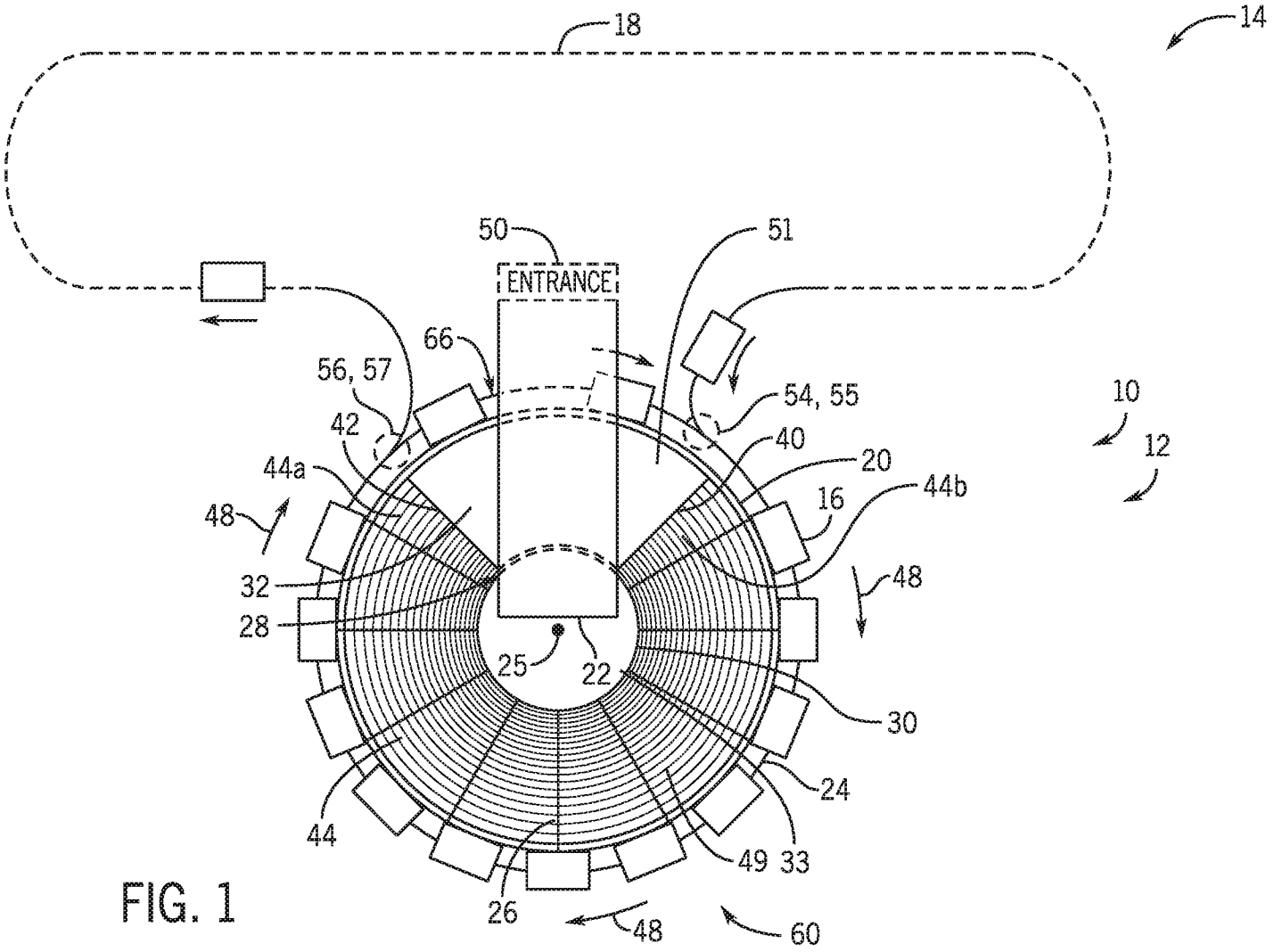
FIG. 1 is a schematic plan view of a loading system.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The disclosed embodiments generally relate to a loading system configured to provide a variable amount of available loading time of passengers into ride vehicles. More specifically, the disclosed techniques permit a variable amount of passenger loading time into a particular ride vehicle while allowing other ride vehicles to continue at nominal speeds through a loading zone and subsequently enter the attraction. For example, the disclosed loading system may include a loading zone platform having moving portions and stationary portions. The loading zone platform includes a continuously rotating turntable that rotates in concert with movement of adjacent ride vehicles traveling along a loading zone track portion, both the turntable and the vehicles moving at relatively lower speeds than the speed of the ride vehicles in the attraction path. More specifically, the rotating turntable may form a partial annulus disposed about a central axis that is interrupted by a stationary portion. The rotating turntable may rotate through only a partial circumference of the total circumference of the loading zone platform. The loading zone is configured to receive occupied ride vehicles (e.g., passenger-occupied vehicles) at a first end of the rotational portion. The ride vehicles and the rotational portion may rotate in conjunction from the first end of the rotational portion to a second end of the rotational portion. The rotational speed of the ride vehicles may substantially match the rotational speed of the turntable such that relative movement between the ride vehicles and the turntable may be substantially unperceivable. In other words, an edge of the turntable may be stationary relative to an edge of the ride vehicle to create a static physical interface, or virtual coupling, between the ride vehicles and the turntable.

When the ride vehicles arrive to the first end of the rotational portion of the turntable from an attraction path, passengers may unload from the ride vehicles onto the rotational portion. Once the passengers are unloaded from the ride vehicles, new passengers may be directed to load the ride vehicles from the rotational portion. Generally, in order to increase a throughput of users through the attraction, the turntable and the ride vehicles may be continuously rotating at a nominal speed as the passengers are unloading and loading the ride vehicles. The ride vehicles may continue to move in conjunction with the turntable until the ride vehicles reach the second end of the rotational portion. During the time it takes for the ride vehicle to arrive at the first end of the rotational portion and rotate to the second end of the rotational portion, the passengers are able to unload and load the ride vehicles. If a particular ride vehicle is occupied with a loaded passenger by the time the ride vehicle reaches the second end of the rotational portion, the ride vehicle may be directed along an attraction path to begin a ride cycle of the attraction.

However, in some instances, a passenger may require more time to load the ride vehicle than is allotted by the ride vehicle traveling from the first end to the second end of the rotational portion of the turntable. Further, in some instances, a passenger may simply have an aversion (e.g., due to a physical or mental status of the passenger) to loading a moving ride vehicle from a moving platform. In such instances, a ride operator may flag a particular ride vehicle to cause the particular ride vehicle to transition to the stationary portion of the turntable from the second end of the rotational portion. As mentioned above, the stationary portion of the turntable may be located circumferentially about the central axis between the first and second ends of the rotational portion of the turntable. While positioned at the stationary portion of the turntable, the passenger may have an increased (e.g., an infinite) amount of time to load into the particular ride vehicle. Once the passenger has successfully loaded into the particular ride vehicle, a ride operator may once again flag the particular ride vehicle to move from the stationary portion to the first end of the rotational portion. From the first end of the rotational portion, the particular ride vehicle may once again travel to the second end of the rotational portion, and be directed from the second end of the rotational portion to the attraction path. In this manner, slower-loading passengers may not cause a disruption to other passengers, as each ride vehicle continues to move at a nominal speed through the loading zone regardless of the ride vehicle loading time of other passengers. Thus, passengers may have an increased amount of available time to load the ride vehicles.

Turning now to the figures, FIG. 1 is a schematic plan view of an embodiment of a loading zone 10 of a loading system 12. As shown, the loading zone 10 may be a portion of an overall ride system 14 (e.g., an attraction). For example, passengers may load into ride vehicles 16 in the loading zone 10, may travel along an attraction path 18 of the ride system 14, and may arrive back at the loading zone 10 to unload from the ride vehicles 16. While traveling along the attraction path 18, passengers may be exposed to a variety of experiences, such as virtual reality, alternate reality, environment interactions, multiple ride paths, water features, special effects, and so forth. It should be noted that portions of the ride system 14, such as the attraction path 18, have been intentionally simplified in order to focus on aspects of the loading system 12.

The load system 12 may include a loading platform 20, an entrance ramp 22, a loading path 24, and the ride vehicles 16. As shown, the loading platform 20 may extend circumferentially about a central vertical axis 25 to form a substantially planar surface in a plane orthogonal to the central vertical axis 25. The loading platform 20 may include a rotational portion 26 (e.g., a rotating turntable) and a stationary portion 28 (e.g., a stationary platform). The stationary portion 28 may include a stationary central portion 30 and a stationary radial portion 32. The stationary central portion 30 may be disposed about the central vertical axis 25. Indeed, as shown, in some embodiments, the stationary central portion 30 may be substantially circular, with a center of the stationary central portion 30 being coaxial with the central vertical axis 25 and concentric with the annulus formed by the rotational portion 26 and the stationary radial portion 32. More specifically, a visible or top surface 49 of the rotational portion 26 may extend only partially circumferentially about the central vertical axis 25 between a first edge 40 and a second edge 42 to form a partial annulus or partial curve that is completed by a top surface 51 of the radial portion 32. The radial portion 32 may also extend only partially circumferentially about the central vertical axis 25 between the first edge 40 and the second edge 42. Indeed, the first edge 40 and the second edge 42 may define circumferential (e.g., relative to the central vertical axis 25) boundaries between the rotational portion 26 and the radial portion 32.

In certain embodiments, the rotation of the rotational portion 26 is a partial rotation from the first edge 40 of the stationary radial portion 32 to the second edge 42 of the stationary radial portion 32. That is, the rotational portion 26 does not form a complete loop about the circumference of the loading platform 20. However, in some embodiments, the rotational portion 26 dips below the stationary radial portion 32 such that the top surface 49 emerges again at the first edge 40. In such embodiments, the rotational portion 26 rotates in a complete loop or a complete rotation about the rotational axis. However, parts of the rotational portion 26 are underneath the common plane and do not form the top surface 49.

Figure 2:
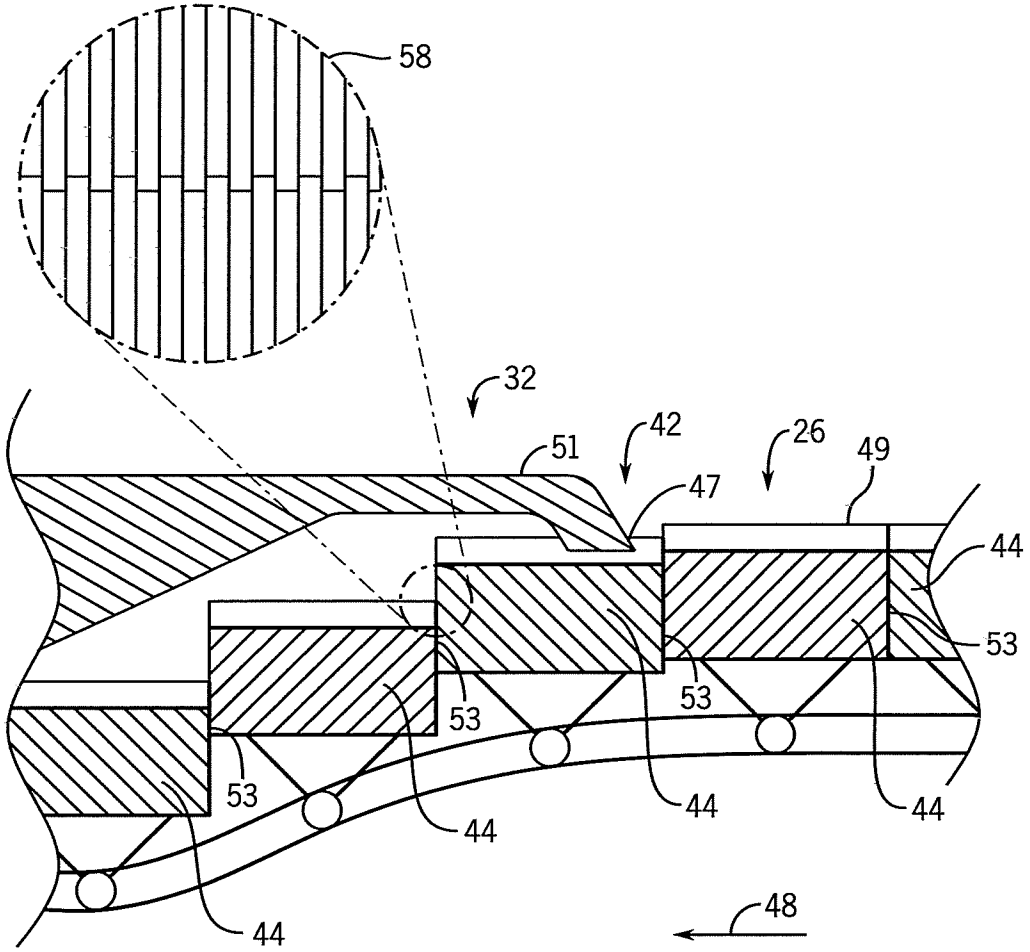
FIG. 2 is a schematic cross-sectional side view of a portion of the loading system of FIG. 1.

The rotational portion 26 may be composed of a series of wedges 44. Rotation of the rotational portion 26 may be driven by rotation of the wedges 44 through the rotational portion 26 about the central vertical axis 25. In certain embodiments, the rotational portion 26 may rotate in a clockwise 48 direction. Generally, the top surfaces 49 of the rotational portion 26 and top surface 51 of the radial portion 32 may both be substantially disposed in a common horizontal plane (e.g., relative to the central vertical axis 25). Accordingly, top surfaces 49 of the wedges 44 in the depicted embodiment are configured to be disposed substantially within the common horizontal plane while rotating through the rotational portion 26, and are configured to traverse below the common horizontal plane while rotating through the stationary radial portion 32. To further illustrate, FIG. 2 is a schematic cross-sectional side view of the wedges 44 in relation to the first edge 40 of the loading system 12. As shown, the top surface 49 of the rotational portion 26 may be substantially coplanar with the top surface 51 of the stationary radial portion 32. In certain embodiments, similar to the functionality of steps in an escalator, adjacent wedges 44 may include a partially vertical interface 53 having interlocking grooves 58 such that adjacent wedges 44 may slide at least partially vertically (e.g., relative to the central vertical axis 25) along the grooves 58 and relative to each other. Indeed, in some embodiments, top surfaces 49 of the wedges 44 and edges 40, 42 of the stationary radial portion 32 may include an interlocking interface 47 (e.g., grooves, teeth, ridges, etc.) similar to the top surfaces of steps of a traditional escalator. For example, as the wedges 44 rotate clockwise 48 through the second edge 42 (e.g., transitioning from the rotational portion 26 to the stationary radial portion 32), the wedges 44 may move vertically beneath the stationary radial portion 32. For example, referring now back to FIG. 1, an individual wedge 44*a* may move out of the plane and in a direction away from or downwards from the top surfaces 49 of its adjacent wedge 44. The wedges 44 may rotate further clockwise 48 beneath the common horizontal plane of the stationary radial portion 32 toward the first edge 40. As the wedges 44 reach the first edge 40, the wedges 44 may transition vertically upwards, shown as the individual wedge 44*b* such that the top surfaces 49 of the wedges 44 are disposed within the common horizontal plane as the wedges 44 pass the first edge 40.

The entrance ramp 22 may be any suitable angled path, which may include stairs, a substantially flat angled surface, an escalator, or any combination thereof. Generally, passengers may enter the loading zone 10 from an entrance 50, descend the entrance ramp 22 toward the central portion 30 of the loading platform 20, and load into the ride vehicle 16. Similarly, users may ascend the entrance ramp 22 toward the entrance 50 to leave the loading zone 10. As shown, the radial portion 32 may be disposed below a portion of the entrance ramp 22.

The ride vehicles 16 may enter the loading zone 10 from the attraction path 18. Particularly, the attraction path 18 may be connected to the loading path 24 at a first connecting location 54 (e.g., a first track switch 55) and at a second connecting location 56 (e.g., a second track switch 57). The ride vehicles 16 may travel from the attraction path 18 to the first connecting location 54, and travel clockwise 48 along the loading path 24 toward the second connecting location 56. As will be appreciated, from the second connecting location 56, the ride vehicles 16 may either be directed (e.g., re-looped) to continue clockwise 48 along the loading path 24 toward the first connecting location 54, or may be directed along the attraction path 18.

As shown, the loading path 24 may be disposed about a perimeter (i.e. circumference) of the loading platform 20. While the ride vehicle 16 is moving along the loading path 24, passengers may load and unload the ride vehicles 16. The loading path 24 may include a track or a conveyor, or may be a virtual path along which the ride vehicles 16 travel. In some embodiments, the loading path 24 is a path along which the ride vehicles 16 travel while rotating in conjunction with (i.e., together with or at the same speed as) the loading platform 20. As shown, while traveling along the loading path 24, the ride vehicles 16 may rotate at substantially the same rotational speed as the loading platform 20. In this manner, a position and orientation of each ride vehicle 16 along the perimeter of the loading platform 20 may remain substantially constant. In other words, each ride vehicle 16 may maintain a temporarily fixed position relative to a circumference of the loading platform 20 while traveling through the loading path 24 and while the loading platform 20 rotates about the central vertical axis 25 such that the orientation of the loading platform 20 relative to the ride vehicle 16 (e.g., with seats facing towards a center or alongside an edge of the loading platform 20) is substantially maintained. For example, in the currently illustrated embodiment having a substantially circular loading platform 20, each ride vehicle 16 may continuously face the central vertical axis 25 of the loading platform 20 as the ride vehicles 16 travel along the loading path 24. In certain embodiments, the rotational speed of the loading platform 20 as well as the speed of the ride vehicles 16 in the loading path 24 is less than an average speed of the ride vehicles 16 in the attraction path 18.

In the depicted embodiment, the ride vehicles 16 are configured to enter the loading zone 10 from the attraction path 18, and traverse the first connecting location 54 to travel clockwise 48 along the loading path 24 towards the second connecting location 56 (e.g., a main portion 60 of the loading path 24). As the ride vehicle 16 travels along the main portion 60 of the loading path 24, passengers may unload from the ride vehicle 16. Once the passengers are unloaded from the ride vehicle 16, new passengers may be directed to load into the ride vehicle 16. The new passengers may attempt to load the ride vehicle 16 as the ride vehicle 16 travels along the main portion 60. If the new passengers have successfully loaded into the ride vehicle 16 before the ride vehicle 16 reaches the second connecting location 56, the ride vehicle 16 may be directed (e.g., via the second track switch 57 of the second connecting location 56) from the loading path 24 to the attraction path 18. However, in some instances, a passenger may request or require extra time to load into the ride vehicle 16, or an operator may subjectively determine that a passenger may benefit from having extra time to load into the ride vehicle 16. For example, a passenger may indicate a preference to not load into the ride vehicle 16 from the rotational portion 26 of the loading platform 20. Accordingly, in such situations, the ride operator may flag the ride vehicle 16 to cause the ride vehicle 16 to transition from the main portion 60 of the loading path 24, across the second connecting location 56, and towards the first connecting location 54 (e.g., a secondary portion 66 of the loading path 24). The ride vehicle 16 may come to a complete stop at the secondary portion 66 of the loading path 24 to allow passengers to load into the ride vehicle 16 from the stationary radial portion 32. In some embodiments, multiple ride vehicles 16 may be stationed along the secondary portion 66 to allow passengers to load into the multiple ride vehicles 16 from the stationary loading portion 28 at the same time. For example, as shown in the current embodiment, the secondary portion 66 may hold approximately two ride vehicles 16. However, it is to be understood that the secondary portion 66 may hold any suitable number of ride vehicles 16.

The secondary portion 66 of the loading path 24 may be disposed beneath the entrance ramp 22. That is, the passengers and the ride vehicle 16 may be disposed beneath the entrance ramp 22 while the passengers attempt to load into the ride vehicle 16. Accordingly, the entrance ramp 22 is arranged such that the clearance underneath the entrance ramp 22 is sufficient to permit clearance of the ride vehicles 16 and any unloaded passengers traveling underneath the entrance ramp 22 from the position of the second connecting location 56 to the first connecting location 54.

Additionally or in the alternative, transitioning the ride vehicle 16 to the secondary portion 66 of the loading path 24 may be based on a loading time of the passengers. For example, if the new passengers have not successfully loaded into the ride vehicle 16 before the ride vehicle 16 reaches the second connecting location 56, the ride vehicle 16 may be directed (e.g., via the second track switch 57), to continue along the loading path 24 toward the first connecting location 54 (e.g., along the secondary portion 66 of the loading path 24). If the ride vehicle 16 is directed from the second connecting location 56 toward the first connecting location 54, the ride vehicle 16 may come to a complete stop along the secondary portion 66 until the passengers have successfully loaded into the ride vehicle 16. That is, if the passengers have not loaded into the ride vehicle 16 by the time the ride vehicle 16 reaches the second connecting location 56, the passengers may transition from the rotational portion 26 to the stationary radial portion 32 to load into the ride vehicle 16, as described above.

After the passengers load into the ride vehicle 16 from the stationary radial portion 32, the ride vehicle 16 may be transitioned across the first connecting location 54 (e.g., from the secondary portion 66 to the main portion 60 via the first track switch 55) to re-loop along the main portion 60 with the ride vehicles 16 incoming from the attraction path 18. The ride vehicle 16 may then travel along the main portion 60 and embark on the attraction path 18 at the second connecting location 56.

Figure 3:
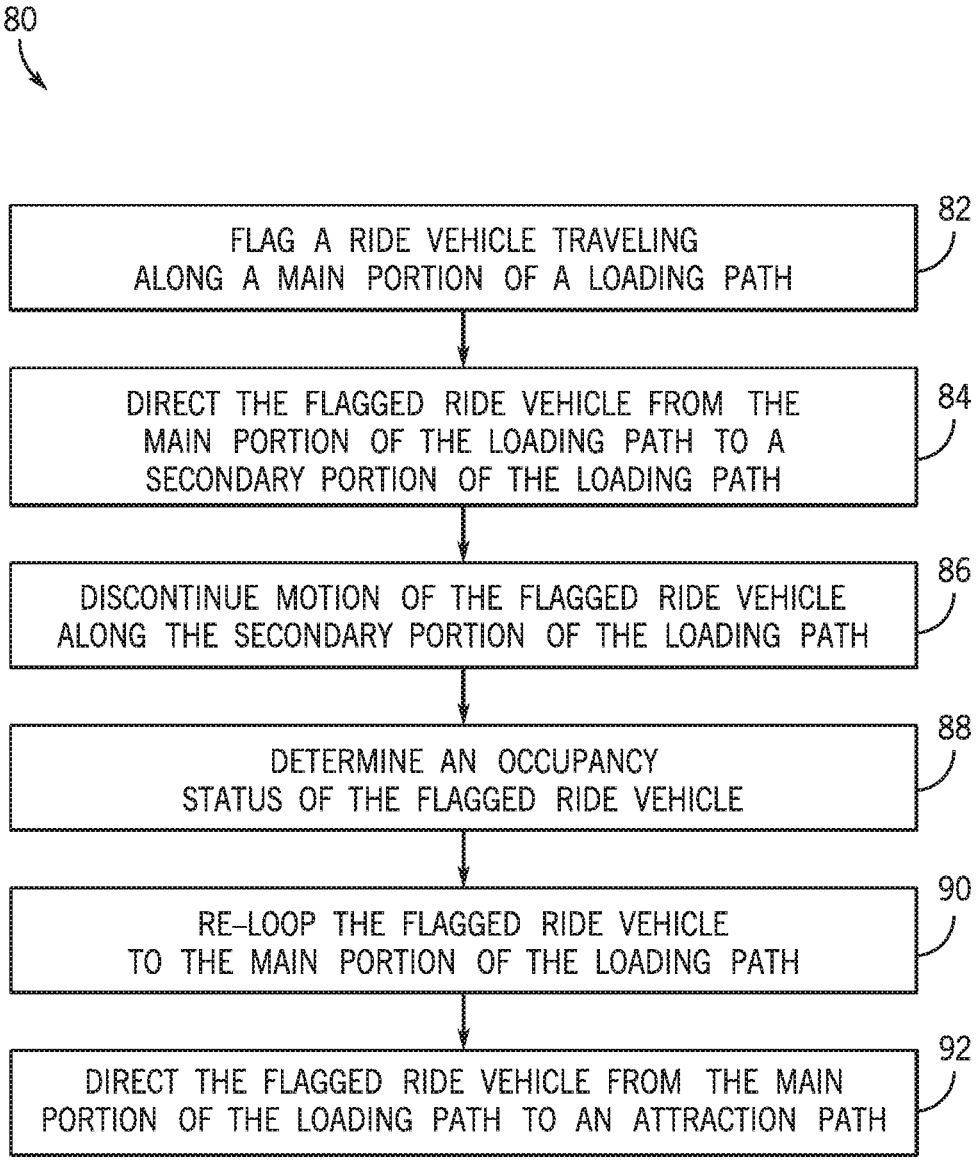
FIG. 3 is a flow diagram of a method of operating the loading system.

Keeping this in mind, FIG. 3 is a flow chart of an embodiment of a loading process 80 that may be utilized by the loading system 12. Accordingly, the following discussion may reference FIG. 1 in parallel with FIG. 3. Further, the following discussion references the progress of a particular ride vehicle 16 through the loading process 80.

At block 82, a ride vehicle 16 traveling (e.g., clockwise 48) along the main portion 60 may be flagged. Particularly, a ride operator may provide an input to a controller (e.g., a vehicle controller and/or an attraction master controller) to flag the ride vehicle 16. Providing the input may include pressing a button on a control panel, utilizing a key, utilizing a short range communication device (e.g., an RFID tag), or any other suitable input. Flagging the ride vehicle 16 distinguishes the ride vehicle 16 from other ride vehicles 16, with regard to operations of the controller. In some embodiments, the ride operator may provide the input to flag the ride vehicle 16 based on request of a passenger wanting to board the ride vehicle 16.

At block 84, the ride vehicle 16 may be directed from the main portion 60 of the loading path 24, which may be adjacent to the rotational portion 26, to the secondary portion 66 of the loading path 24, which may be adjacent to the stationary radial portion 32. That is, in some embodiments, the second track switch 57 disposed at the second connecting location 56 may direct the ride vehicle 16 from the main portion 60 to the secondary portion 66, as opposed to directing the ride vehicle 16 from the main portion 60 to the attraction path 18. In some embodiments, the embodiments described in block 82 may enable (e.g., trigger) the embodiments described in reference to block 84.

At block 86, the ride vehicle 16 may discontinue motion along the secondary portion 66 of the loading path 24. In other words, the ride vehicle 16 may come to a stop along the secondary portion 66 adjacent to the stationary radial portion 32. In some embodiments, a braking system of the ride vehicle 16 may be activated to cause the ride vehicle 16 to come to a stop at the secondary portion 66. Further still, in some embodiments, the ride operator may simply guide the ride vehicle 16 (e.g., by grabbing onto the ride vehicle 16 with a hand or device and walking along the loading platform 20) to a stationary position along the secondary portion 66 of the loading path 24.

At block 88, an occupancy status of the ride vehicle 16 may be determined. For example, the ride operator may determine that passengers are fully loaded and secured into the ride vehicle 16. Upon determining as such, the ride operator may provide an occupancy confirmation input to the controller. Providing the input may include pressing a button on a control panel, utilizing a key, utilizing a short range communication device (e.g., an RFID tag), or any other suitable input. The ride operator may provide the input based on their subjective discretion. That is, the ride operator may determine to provide the input when the ride vehicle is fully occupied, partially occupied, or empty of passengers. Further still, in some embodiments, the occupancy status of the ride vehicle 16 may be based on one or more sensors detecting the presence of passengers in the ride vehicles and a status of restraints of the ride vehicle, and providing the occupancy confirmation input to the controller.

At block 90, the ride vehicle 16 may be re-looped to the main portion 60 of the loading path 24 from the secondary portion 66 (e.g., via the first track switch 55 at the first connecting location 54). That is, the ride vehicle 16 may be placed within a flow of ride vehicles 16 incoming from the attraction path 18 to the loading zone 10.

To illustrate, the ride vehicles 16 moving along the main portion 60 of the loading path 24 may generally move along the loading path 24 at constant intervals. As such, assuming that each ride vehicle 16 is also directed along the attraction path 18 from the main portion 60, the ride vehicles 16 may also generally travel along the attraction path 18 at constant intervals. However, as described in the embodiments of block 84, the ride vehicle 16 may be directed from the main portion 60 to the secondary portion 66, as opposed to being directed along the attraction path 18, at the second connecting location 56. In such embodiments, an extended interval (e.g., a gap, a bubble, a space), may occur between two adjacent vehicles 16 traveling along the attraction path 18 due to the ride vehicle 16 having been disposed between the adjacent vehicles 16 along the loading path 24 being directed to the secondary portion 66 of the loading path 24 instead of to the attraction path 18.

The adjacent ride vehicles 16 may travel along the attraction path 18 while maintaining the extended interval therebetween. Accordingly, as the adjacent ride vehicles 16 arrive back at the loading zone 10 from the attraction path 18, the ride vehicle 16 in the secondary portion 66 may transition to the main portion 60 of the loading path 24 such that the ride vehicle 16 is disposed between the two adjacent ride vehicles 16 (e.g., in the extended interval therebetween). For example, upon receiving the occupancy confirmation signal (e.g., block 88), the ride vehicle 16 may prepare to transition into the extended interval (the extended interval that the ride vehicle 16 created by transitioning to the secondary portion 66) traveling along the attraction path 18. Indeed, the embodiments of block 90 may be triggered or implemented based on the embodiments of block 88. As the adjacent ride vehicles 16 having the extended interval therebetween arrive at the first connecting location 54 from the attraction path 18, the ride vehicle 16 may transition into the space between the adjacent ride vehicles 16 to continue along the main portion 60 of the loading path 24.

At block 92, the ride vehicle 16 may transition from the main portion 60 of the loading path 24 to the attraction path 18 (e.g., via the second track switch 57) at the second connecting location 56. Indeed, because the passengers have already loaded into the ride vehicle 16 from the stationary radial portion 32 while the ride vehicle 16 was stopped at secondary portion 66, the ride vehicle 16 may be directed to the attraction path 18 upon arriving to the second connecting location 56 to complete a ride cycle.

In some embodiments, to unload from the ride vehicle 16 (e.g., after the ride vehicle 16 has completed a ride cycle along the attraction path 18), the ride vehicle 16 may be flagged again (e.g., block 82) to transition to the secondary portion 66 of the loading path 24, in order to allow the passengers to unload onto the stationary radial portion 32. Thus, other passengers may also load into the ride vehicles 16 while the ride vehicle 16 is still stationed at the radial portion 32. In some embodiments, the ride vehicle 16 may be a continuously flagged vehicle such that the ride vehicle 16 may be directed to stop at the secondary portion 66 of the loading path 24 after every ride cycle.

Figure 4:
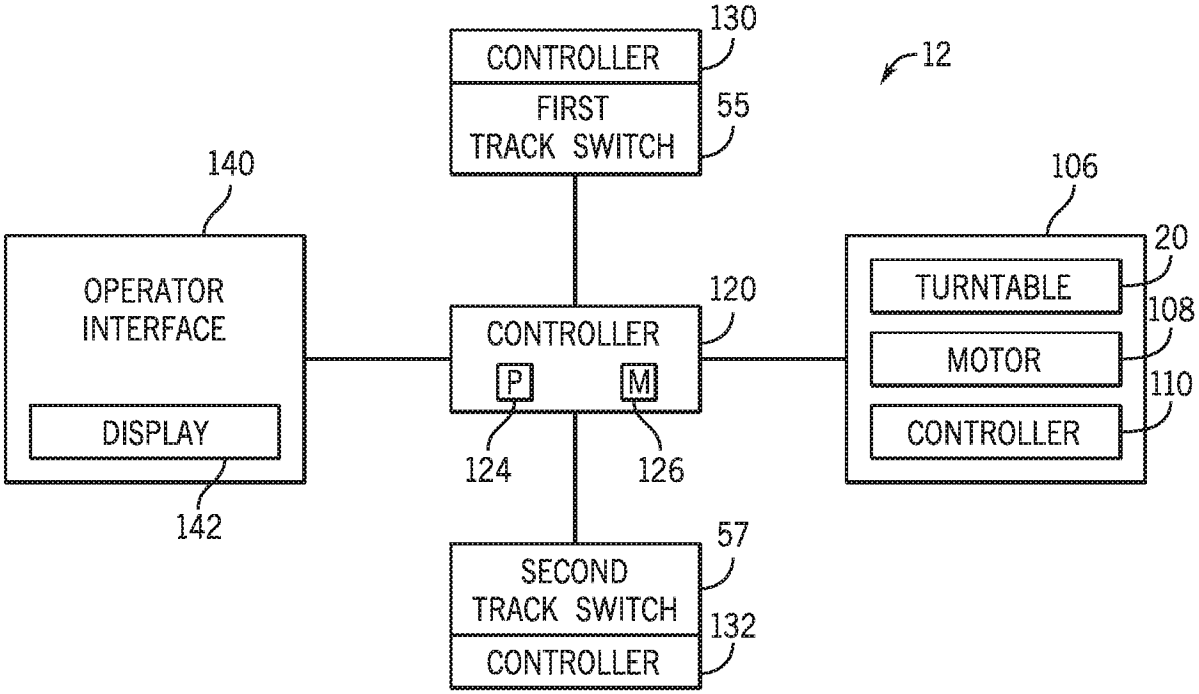
FIG. 4 is a block diagram of an embodiment of the loading system.

The FIG. 4 is a block diagram of the loading system 12. As seen in FIG. 4, the loading system includes a turntable assembly 106 that drives rotation of the loading platform 20 via a motor 108 and a turntable controller 110. The turntable controller 110 may be coupled to a central ride controller 120 (e.g., an attraction controller), and may communicate through a wireless network (e.g., wireless local area networks [WLAN], wireless wide area networks [WWAN], near field communication [NFC]) and/or through a wired network (e.g., local area networks [LAN], wide area networks [WAN]). The controller 120 includes a processor 124 and a memory 126. It should be understood that other disclosed components of the loading system 12 may also include a memory and processor and may operate to execute processor-based instructions stored in a memory. The central ride controller 120 may also control vehicle movement, and may communicate with the first track switch 55 and the second track switch 57 and their respective controllers 130, 132 to direct movement of the ride vehicles 16 between the attraction path 18 and the loading path 24. For example, in one embodiment, the controller 120 may receive a signal, or data, that one or more ride vehicles 16 approaching the second track switch 57 are not flagged. As the ride vehicle or ride vehicles 16 approach the second track switch 57, the second track switch 57 receives a signal to switch to (or remain in) a position to direct the ride vehicles 16 onto the attraction path 18. In another example, when the ride system 14 is in operation and the ride vehicles 16 traversing the loading path 24 is flagged, the second track switch 57 receives a signal from the controller 120 to move to (or remain in) a position to re-loop the ride vehicle 16 toward the secondary portion 66 of the loading path 24.

The central controller 120 may permit operator input via an operator interface 140, which may include a display 142. In some embodiments, an operator may send one or more signals to the central controller 120 via the operator interface 140 to operate the loading system 12 as discussed herein.

Overall, the embodiments disclosed herein systems and methods configured to provide variable loading time for passengers loading into ride vehicles. For example, the disclosed embodiments include an attraction with a loading zone having ride vehicles configured to rotate in conjunction with a turntable while passengers unload and load the ride vehicles. Generally, passengers have a set amount of time to load into the ride vehicles as the ride vehicles travel through the loading zone. However, a passenger may prefer more than the set amount of time, or may prefer to load into the ride vehicles from a stationary surface. Accordingly, the turntable may include a stationary portion and a rotational portion. Normally, passengers may load into the ride vehicles in the rotational portion and may be directed to start a ride cycle from the rotational portion. However, the turntable also includes a stationary portion configured to hold ride vehicles still for a period of time while other vehicles continue to move through the loading zone via the rotational portion. As such, some passengers that require extra time to load into the ride vehicles may do so without disrupting the throughput of other ride vehicles. The uninterrupted progress of the ride vehicles through the attraction enables the attraction to cycle high volumes of guest through the attraction, thereby increasing an efficiency of the attraction.

While only certain features of present embodiments have been illustrated and described herein, many modifications and changes will occur to those skilled in the art. It is, therefore, to be understood that the appended claims are intended to cover all such modifications and changes that fall within the true spirit of the disclosure. Further, it should be understood that certain elements of the disclosed embodiments may be combined or exchanged with one another.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An attraction loading system, comprising:

a loading platform comprising:

a rotational portion configured to rotate about a central vertical axis of the loading platform; and a stationary portion extending between a first edge and a second edge, wherein the first edge and the second edge of the stationary portion comprise respective interfaces of the stationary portion with the rotational portion and wherein the rotational portion rotates from the first edge to the second edge;

a loading path disposed about a circumference of the loading platform, wherein a ride vehicle is configured to travel along the loading path; and a track switch configured to move the ride vehicle onto an attraction path from a main portion of the loading path in a first configuration and onto a secondary portion of the loading path to re-loop the ride vehicle in a second configuration.

2. The attraction loading system of claim 1, wherein respective top surfaces of the rotational portion and the stationary portion are disposed substantially within a common plane disposed orthogonally relative to the central vertical axis.

3. The attraction loading system of claim 1, wherein a rotational speed of the rotational portion is configured to substantially match a travel speed of the ride vehicle along the loading path such that a particular point on a top surface of the rotational portion maintains a fixed distance from the ride vehicle while the ride vehicle travels along the loading path.

4. The attraction loading system of claim 3, wherein the stationary portion is configured to be stationary relative to the ride vehicle while the ride vehicle travels along the loading path such that a distance between the ride vehicle and another particular point on the stationary portion changes during the traveling.

5. The attraction loading system of claim 1, further comprising a central portion positioned coaxially within the loading platform, wherein the central portion does not rotate with the rotational portion.

6. The attraction loading system of claim 5, comprising a passenger entrance path that connects to the central portion.

7. The attraction loading system of claim 1, wherein the rotational portion comprises a plurality of wedges coupled to one another via respective interlocking grooves.

8. The attraction loading system of claim 7, wherein an individual wedge of the plurality of wedges positioned adjacent to the second edge is configured to move out of a plane of the loading platform during rotation of the rotation portion to bring another wedge of the plurality of wedges into position adjacent to the second edge.

9. The attraction loading system of claim 7, wherein an individual wedge of the plurality of wedges adjacent to the first edge is configured to rotate away from the first edge while another wedge moves into a plane of the loading platform and into position adjacent to the first edge.

10. The attraction loading system of claim 7, wherein each individual wedge of the plurality of wedges is configured to move vertically relative to adjacent wedges of the plurality of wedges via movement along the respective interlocking grooves.

11. The attraction loading system of claim 1, comprising a second track switch configured to move the ride vehicle onto a main portion of the loading path from the attraction path in a first configuration or from the secondary portion of the loading path onto the main portion of the loading path in a second configuration.

12. The attraction loading system of claim 11, wherein the secondary portion of the loading path is at least in part adjacent to the stationary portion of the loading platform.

13. The attraction loading system of claim 1, wherein the rotational portion rotates under the stationary portion.

14. The attraction loading system of claim 1, wherein a rotational range of a rotational portion top surface substantially in a common plane with a stationary portion top surface is between the first edge and the second edge.

15. A method to load passengers into ride vehicles, the method comprising:

receiving a sensor signal indicative of an occupancy status of a ride vehicle that is traveling along a first portion of a loading path;

controlling a track switch to switch from a first configuration to a second configuration, wherein the first configuration couples the first portion of the loading path to an attraction path and wherein the second configuration couples the first portion of the loading path to a second portion of the loading path based on the sensor signal being indicative of a not fully loaded occupancy status of the ride vehicle;

directing the ride vehicle to stop along the second portion of the loading path;

receiving an occupancy confirmation signal of the ride vehicle while stopped along the second portion of the loading path; and controlling the track switch to cause the ride vehicle to re-loop along the first portion of the loading path based on the occupancy confirmation signal.

16. The method of claim 15, comprising directing the ride vehicle from the first portion of the loading path to the attraction path after the ride vehicle travels along the first portion of the loading path.

17. The method of claim 15, comprising directing the ride vehicle from the attraction path to return to the first portion of the loading path after completing the attraction path.

18. The method of claim 15, comprising controlling rotation of a rotational portion of a loading platform to match a speed of the ride vehicle along the first portion of the loading path.

19. An attraction loading platform system, comprising:

a loading platform, comprising a stationary portion and a rotational portion, wherein the rotational portion rotates about a central vertical axis of the loading platform and from a first edge of the stationary portion to a second edge of the stationary portion;

a motor configured to rotate the rotational portion;

a controller configured to control a speed of the rotation; and a track switch configured to switch between a first configuration and a second configuration such that a ride vehicle moves onto a main portion of a loading path from an attraction path in the first configuration or from a secondary portion of the loading path onto the main portion of the loading path in the second configuration, wherein the loading path is disposed about the loading platform.

20. The attraction loading platform system of claim 19, wherein the rotational portion is further configured to rotate from the second edge to the first edge by passing under the stationary portion.

* * * * *